United States Patent [19]

Eskesen et al.

[11] 4,177,011

[45] Dec. 4, 1979

[54] BAR FOR SEALING THE GAP BETWEEN ADJACENT SHROUD PLATES IN LIQUID-COOLED GAS TURBINE

[75] Inventors: John H. Eskesen; Herman M. Leibowitz, both of Schenectady, N.Y.

[73] Assignee: General Electric Company, Schenectady, N.Y.

[21] Appl. No.: 678,950

[22] Filed: Apr. 21, 1976

[51] Int. Cl.[2] ..... F01D 9/04

[52] U.S. Cl. ..... 416/191; 416/97 R; 416/195

[58] Field of Search ..... 416/191, 221, 190, 96, 416/97, 193 A; 277/25

[56] References Cited

U.S. PATENT DOCUMENTS

| | | | |
|---|---|---|---|
| 3,202,398 | 8/1965 | Webb | 416/221 |
| 3,709,631 | 1/1973 | Karstensen et al. | 416/221 |
| 3,752,598 | 8/1973 | Bowers et al. | 416/191 |

*Primary Examiner*—Robert I. Smith

*Attorney, Agent, or Firm*—Richard G. Jackson; Joseph T. Cohen; Paul R. Webb, II

[57] ABSTRACT

A sealing bar is provided for each gap between adjacent shroud plates to form part of the coolant recovery system of an open-circuit, liquid-cooled gas turbine. The undersides of the edges of the shroud plates at each gap are chamfered and a small cylindrical bar is supported in the recess provided thereby. Centrifugal force urges the bar into sealing engagement with the chamfered surfaces.

5 Claims, 4 Drawing Figures

BAR FOR SEALING THE GAP BETWEEN ADJACENT SHROUD PLATES IN LIQUID-COOLED GAS TURBINE

BACKGROUND OF THE INVENTION

Structural arrangement for the open-circuit liquid cooling of gas turbine vanes are shown in U.S. Pat. No. 3,446,481—Kydd. The cooling of the vanes is accomplished by means of a large number of spanwise-extending subsurface cooling channels. Arrangements for metering liquid coolant to such cooling channels are shown in U.S. Pat. No. 3,658,439—Kydd, in U.S. Pat. No. 3,804,551—Moore, and in U.S. Pat. No. 3,856,433—Grondahl et al.

The use of serpentine cooling channel construction for open-circuit liquid cooling of turbine vanes and platforms is disclosed in U.S. Pat. No. 3,844,679—Grondahl et al. and U.S. Pat. No. 3,849,025—Grondahl. In each of the latter two patents each convoluted cooling channel is fed liquid coolant directly from a gutter integral with the rotor via a coolant supply conduit.

Constructions by which the coolant discharge from liquid-cooled gas turbine buckets is collected to enable recirculation thereof are disclosed in U.S. Pat. No. 3,736,071—Kydd and in the U.S. Pat. No. 3,816,022—Day.

All of the aforementioned patents are incorporated by reference.

A coolant recovery system for a shrouded opencircuit, liquid-cooled gas turbine is set forth as the embodiment in FIGS. 1, 2 and 3 of the Day patent wherein the coolant discharge (gas or vapor and excess liquid coolant) from the turbine bucket vanes passes via convergent-divergent nozzles into the annular cavity defined by the shroud, the casing and the labyrinth seals. The Day invention, however, does not address itself to the problem of leakage into or out of this cavity.

The leakage of high energy gas from the working fluid stream into this cavity introduces a significant penalty in stage performance, thereby depressing the thermal efficiency of the cycle. Particularly with liquid-cooled turbines leakage into the cavity should be minimized to avoid the generation of corrosive agents by the interaction between the by-products of combustion in the working fluid and the liquid coolant (e.g. water). Similarly, leakage from the aforementioned cavity into the working fluid stream should be avoided in order that the liquid coolant (usually water) consumption can be kept within acceptable limits.

Thus, regardless of the relative pressure conditions in the cavity and the working fluid stream an effective, low-cost seal is required between adjacent shroud plates. The instant invention is directed to the solution of this problem.

DESCRIPTION OF THE INVENTION

A sealing bar is provided for each gap between adjacent shroud plates to form part of the coolant recovery system of an open-circuit, liquid-cooled gas turbine. The undersides of the edges of the shroud plates at each gap are chamfered and a small cylindrical bar is supported in the recess provided thereby. Centrifugal force surges the bar into sealing engagement with the chamfered surfaces.

Adjacent sides of the shroud plates are each made as a pair of planar surfaces angularly disposed. Thus, each pair of shroud plates defines a linearly extending gap, when the rotor is at rest, and a recess radially inward thereof aligned therewith. The cylindrical sealing bar is held in place in this recess by holding means affixed to each end thereof. Each such holding means fits into a recessed portion at the edges of the shroud plates and folds over the radially outer surfaces of the shroud plates. The sealing bar and mounting means therefor can be prepared as a unitary construction, which can be properly located between adjacent shroud plates, when the turbine buckets to which the shroud plates are affixed are inserted into the turbine rotor rim. For convenience of assembly one of the tabs on each bar assembly may be pre-bent and the other tab bent after assembly of the buckets into the rotor rim.

BRIEF DESCRIPTION OF THE DRAWING

The features of this invention believed to be novel and unobvious over the prior art are set forth with particularity in the appended claims. The invention itself, however, as to the organization, method of operation, and objects and advantages thereof, may best be understood by reference to the following description taken in conjunction with the accompanying drawing wherein:

MANNER AND PROCESS OF MAKING AND USING THE INVENTION

The embodiment for the sealing bar described hereinbelow is the best mode contemplated of this invention.

Figure 1:
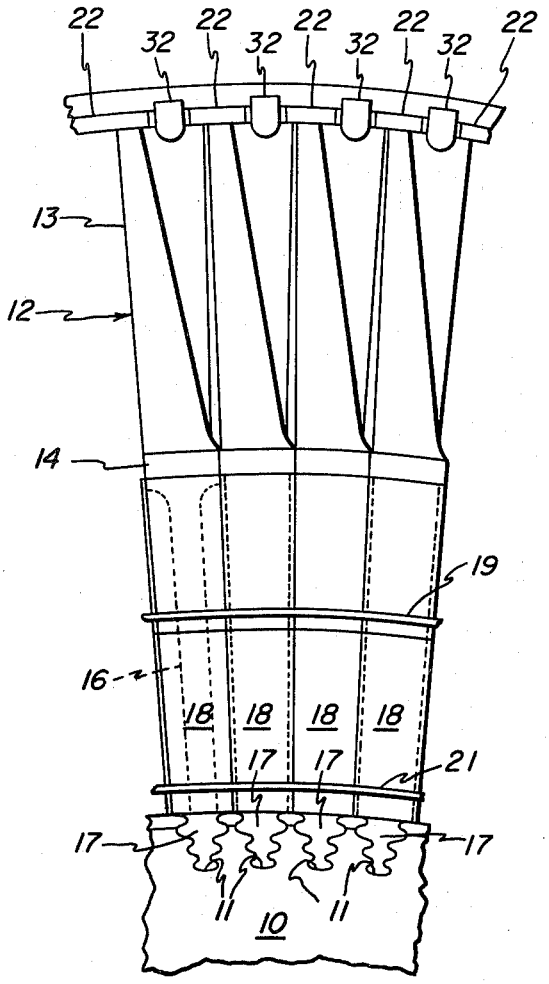
FIG. 1 is an elevational view of a portion of a turbine rotor, looking in the axial direction, showing several long-shank liquid-cooled turbine buckets mounted on the turbine rotor rim.
Figure 3:
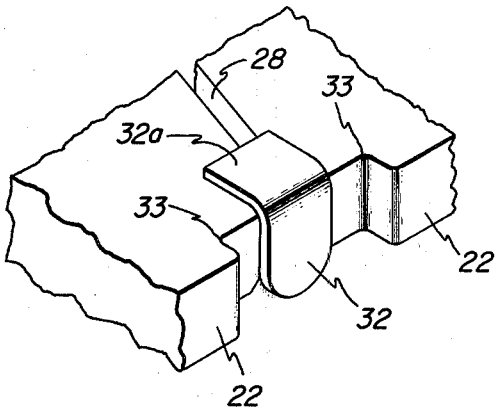
FIG. 3 is a three-dimensional view showing the accommodation of the shroud plates for the mounting tabs.
Figure 4:
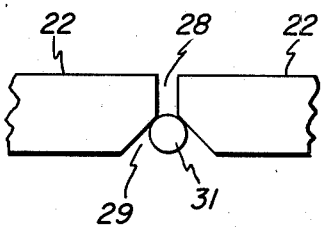
FIG. 4 is a sectional view taken on line 4—4 of FIG. 2.
Figure 2:
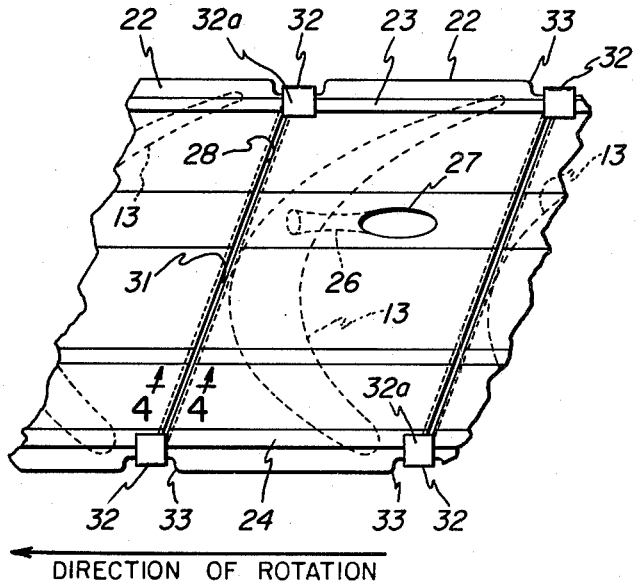
FIG. 2 is a view directed radially inward showing the interrelationship between adjacent shroud plates, the sealing rod and mounting tabs therefor.

Referring now to FIG. 1 of the drawing, a portion of turbine rim 10 is shown which is furnished with a group of circumferentially-spaced axially extending dovetailed slots 11 extending around its periphery. Disposed in each of the slots 11 is a long-shank turbine bucket, shown generally as 12, which includes a vane portion 13, an arcuate bucket platform 14, which forms a portion of the radially inner boundary wall for the motive (or working) fluid, flowing through the turbine, and a radially-extending bucket shank 16. Shank 16 serves to connect platform 14 to the dovetail base portion 17, which fits in slot 11.

Specific details of the manner in which liquid coolant is provided, distributed, metered to the buckets and recovered are not shown in detail, because they do not form part of this invention. Construction particularly adaptable to the liquid cooling of long-shank turbine buckets is disclosed in U.S. patent application Ser. No. 659,576—Darrow filed Feb. 19, 1976, and assigned to the assignee of the instant invention. The provisions for liquid cooling of the buckets set forth therein are incorporated by reference.

Extending radially between rim 10 and bucket platforms 14 are a number of cover plates 18, which serve to block gas flow between shanks 16. Plate portions 18 may be provided with arcuate axially-extending flanges 19, 21, which cooperate to form two axially-extending sealing rings for cooperation with a stationary diaphragm (not shown) to prevent the flow of gas radially between the rotor and the diaphragm.

By way of example, subsurface cooling channels (not shown) conduct cooling liquid through vanes 13 at a uniform depth beneath the airfoil surface and the heated coolant (gas or vapor and excess liquid coolant), after being discharged from vanes 13, passes into the annular cavity (not shown) defined by shroud plates 22, the turbine casing (not shown) and the labyrinth seals or rib portions 23, 24 extending along opposite sides of each shroud plate segment. This flow from vane 13 to the aforementioned cavity may be via a nozzle comprising converging portion 26 and diverging portion 27 in the general manner described in the Day patent or may be a passage of some other configuration.

Although gaps 28 between adjacent shroud plates 22 can be minimized by judicious design, the presence of some space therebetween must be accepted, since the designer can never define with certainty just how much re-orientation will occur between shroud plates during operation when the airfoil is stressed by centrifugal and aerodynamic loads. Thus, although gap 28 is shown as being of uniform width, the sealing bar of the instant invention provides the requisite sealing action during operation whether gap 28 is of uniform width, is wedge-shaped or is asymetric due to radial deformation. The prime advantage of this sealing arrangement is that it will function in a dynamic system, that is, even in the presence of continuing re-adjustment of the bucket/-shroud construction under the conditions imposed by the prevailing inertial field.

The accommodation, therefore, demanded of the sealing bar requires that the sealing bar be resilient and be capable of being deformed along its longitudinal axis. Thus, the bar should, for example, be made of a material such as annealed stainless steel or an annealed nickel-based alloy, which is deformable at turbine operating temperatures.

Each shroud plate 22 has a chamfer extending along the radially-inner edge of each side thereof that abuts an adjacent shroud plate. Each pair of such adjacent chamfers defines a chamfer recess or chamfered region 29, which accommodates a small cylindrical bar, or rod, 31 held in place by a holding means 32 affixed to each end thereof. Each of the four corners of every shroud plate 22 has a notched-out portion 33 providing, together with the adjacent shroud plate, a recess to accommodate each holding means 32, which fits therein and has a tab portion **32*a* that folds over the upper (radially outer) surface of adjoining shroud plate 22. In this manner, the sealing bar remains suspended in region 29 ready to be urged outward into sealing relationship with the chamfered surfaces of shroud plates 22 under the effect of the considerable centrifugal force acting on bar 31 during rotation of the turbine rotor. In this manner bar 31** adjusts to the configuration of the gap prevailing during operation of the turbine, closing it and providing the requisite sealing function.

The angle of chamfer is not critical, but as formed, the surface produced along the chamfer should be planar. The holding means/sealing bar combination may be unitary (i.e. made from a single piece of stock) or the holding means may be rigidly affixed to the ends of the sealing bar as by welding. As noted hereinabove, the tab portion **32*a*** at one end may be designed to be bent over after the holding means/sealing bar combination has been properly located in the chamfer recess.

Use of a bar of circular cross-section is preferred, but angular (i.e. triangular) cross-sections may be employed, if desired.

What I claim as new and desire to secure by Letters Patent of the United States is:

1. In an elastic fluid-utilizing apparatus wherein are mounted a rotor member rotatable about a central axis, an annular row of vanes mounted on said rotor member, a shroud plate segment affixed to each of said vanes, said shroud plate segments having adjacent end faces spaced apart and defining longitudinally extending gaps therebetween, flow discharge means interconnecting each of said vanes and the radially outer surface of the shroud plate segment affixed thereto to provide for the passage of fluid discharged from said vanes to the region radially outward of said shroud plate segments, said region being defined in part by rib portions extending along each side of each shroud plate segment, the improvement comprising:

each of said adjacent end faces of said shroud plate segments having a chamfer extending longitudinally along the radially inner edge thereof as a planar surface, each pair of adjacent chamfered portions defining a straight longitudinally-extending recess, a single longitudinally-extending sealing bar disposed in and along each such recess by means of holding means rigidly affixed to each end of said sealing bar, each holding means having a tab portion overlying the radially outer surfaces of a pair of adjacent shroud plates whereby each sealing bar can move only a limited distance in the radially inward direction and is moved into contact with the juxtaposed chamfered portions when subjected to sufficient centrifugal force.

2. The improvement recited in claim 1 wherein each sealing bar is circular in right cross-section.

3. The improvement recited in claim 1 wherein each holding means is disposed in a recess defined by notches in the adjacent corners of the shrough plates.

4. The improvement recited in claim 1 wherein the shape of each shroud plate as viewed in plan is a parallelogram.

5. The improvement recited in claim 4 wherein the parallelogram is non-rectangular.

* * * * *